US011365860B2

(12) United States Patent
Chen et al.

(10) Patent No.: US 11,365,860 B2
(45) Date of Patent: Jun. 21, 2022

(54) OPTICAL LENS

(71) Applicant: Young Optics Inc., Hsinchu (TW)

(72) Inventors: S-Wei Chen, Hsinchu (TW); Chen-An Chiang, Hsinchu (TW); Hung-Ying Lin, Hsinchu (TW); Chia-Chang Lee, Hsinchu (TW)

(73) Assignee: YOUNG OPTICS INC., Hsinchu Science Park (TW)

( * ) Notice: Subject to any disclaimer, the term of this patent is extended or adjusted under 35 U.S.C. 154(b) by 0 days.

(21) Appl. No.: 17/320,961

(22) Filed: May 14, 2021

(65) Prior Publication Data

US 2021/0356092 A1 Nov. 18, 2021

(30) Foreign Application Priority Data

May 18, 2020 (TW) ..... 109116436
Apr. 27, 2021 (TW) ..... 110115170

(51) Int. Cl.
*F21S 41/25* (2018.01)
*F21S 41/24* (2018.01)

(52) U.S. Cl.
CPC ..... *F21S 41/25* (2018.01); *F21S 41/24* (2018.01)

(58) Field of Classification Search
None
See application file for complete search history.

(56) References Cited

U.S. PATENT DOCUMENTS

2016/0252226 A1* 9/2016 Shih ..... F21S 43/239 362/511
2017/0009945 A1* 1/2017 Takahashi ..... F21S 41/176
2018/0195694 A1* 7/2018 Jutte ..... G02B 27/0927

FOREIGN PATENT DOCUMENTS

TW I550310 B 9/2016

* cited by examiner

*Primary Examiner* — Elmito Breval
(74) *Attorney, Agent, or Firm* — Muncy, Geissler, Olds & Lowe, P.C.

(57) ABSTRACT

An optical lens includes a first lens, a light guide and a second lens arranged in order in a direction of an optical axis of the optical lens. The light guide has a first end and a second end opposite the first end, and an inner surface of the light guide touches at least a part of an outer edge of the second lens.

20 Claims, 10 Drawing Sheets

OPTICAL LENS

BACKGROUND OF THE INVENTION a. Field of the Invention

The invention relates generally to an optical lens and, more particularly, to an optical lens having a light guide.

b. Description of the Related Art

In a typical projection lens for a vehicle lamp, alternate bright and dark zones often appear on a light emission surface of the projection lens to cause non-uniformity of brightness in areas. For example, as shown in FIG. 1, apparent dark zones may appear on the periphery of a light emission surface, which indicates light cannot be spread across the entire projection lens, to cause poor visual feels and low light utilization efficiency.

The information disclosed in this "BACKGROUND OF THE INVENTION" section is only for enhancement understanding of the background of the invention and therefore it may contain information that does not form the prior art already known to a person of ordinary skill in the art. Furthermore, the information disclosed in this "BACKGROUND OF THE INVENTION" section does not mean that one or more problems to be solved by one or more embodiments of the invention is acknowledged by a person of ordinary skill in the art.

BRIEF SUMMARY OF THE INVENTION

According to one aspect of the present disclosure, an optical lens includes a first lens, a light guide and a second lens arranged in order in a direction of an optical axis of the optical lens. The light guide has a first end and a second end opposite the first end, and an inner surface of the light guide touches at least a part of an outer edge of the second lens.

According to another aspect of the present disclosure, an optical lens includes a first lens, a light guide and a second lens arranged in order in a direction of an optical axis of the optical lens. The light guide has a first end and a second end opposite the first end, and each of the first end and the second end is provided with an opening. An area of the opening at the first end is larger than an area of the opening at the second end, and at least a part of the second lens is disposed inside the opening at the second end. A positioning structure is provided on corresponding positions of an inner surface of the light guide and an outer edge of the second lens to fix the light guide and the second lens relative to each other.

According to another aspect of the present disclosure, an optical lens includes a light guide, a first lens and a second lens. The light guide has a first end and a second end opposite the first end, the first lens is disposed at the first end of the light guide, and a surface of the first end covers at least a part of a surface of the first lens. The second lens is disposed at the second end of the light guide, and a surface of the second end covers at least a part of a surface of the second lens.

According to another aspect of the present disclosure, an optical lens includes a first lens with a positive refractive power, a light guide, and a second lens arranged in order in a direction of an optical axis of the optical lens. The light guide has a first end and a second end opposite the first end, and the second end is closer to the second lens as compared with the first end of the light guide. Each of the first end and the second end is provided with an opening, an area enclosed by an inner perimeter of the second end is smaller than a radial area of the second lens, and the opening at the second end of the light guide is disposed at a narrowest part of an active light transmission region measured in the direction of the optical axis.

In accordance with the above aspects, the optical lens is provided with a light guide to increase the amount of light propagating in the periphery of the optical lens to enhance the luminous uniformity and visual feels. Besides, in accordance with the above aspects, because an inner surface of the light guide touches at least a part of an outer edge of the second lens, or a surface of the second end covers at least a part of a surface of the second lens, the light entering the light guide is mainly the stray light that travels outside an active light transmission region. As a result, the stray light can be recycled for use to reduce loss of optical energy and thus improve light utilization efficiency. Further, because a positioning structure is provided on corresponding positions of an inner surface of the light guide and an outer edge of a lens, the light guide is allowed to cooperate with a lens barrel to fix at least one lens in the lens barrel, thereby eliminating the use of a separate positioning piece such as a spacer.

Other objectives, features and advantages of the invention will be further understood from the further technological features disclosed by the embodiments of the invention wherein there are shown and described preferred embodiments of this invention, simply by way of illustration of modes best suited to carry out the invention.

DETAILED DESCRIPTION OF THE INVENTION

In the following detailed description of the preferred embodiments, directional terminology, such as "top," "bottom," "front," "back," etc., is used with reference to the orientation of the Figure(s) being described. The components of the invention can be positioned in a number of different orientations. As such, the directional terminology is used for purposes of illustration and is in no way limiting. Further, "First," "Second," etc, as used herein, are used as labels for nouns that they precede, and do not imply any type of ordering (e.g., spatial, temporal, logical, etc.).

Figure 2:
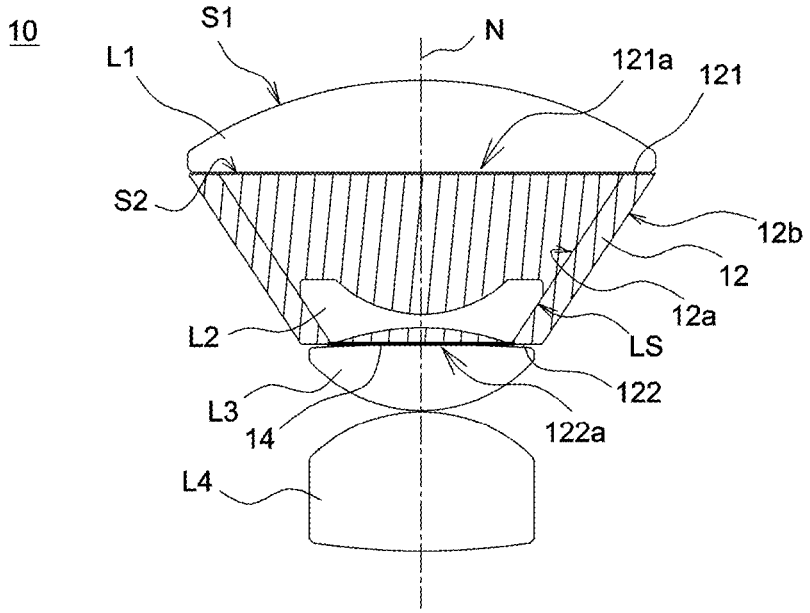
FIG. 2 shows a schematic cross-section of an optical lens in accordance with an embodiment of the invention.
Figure 3:
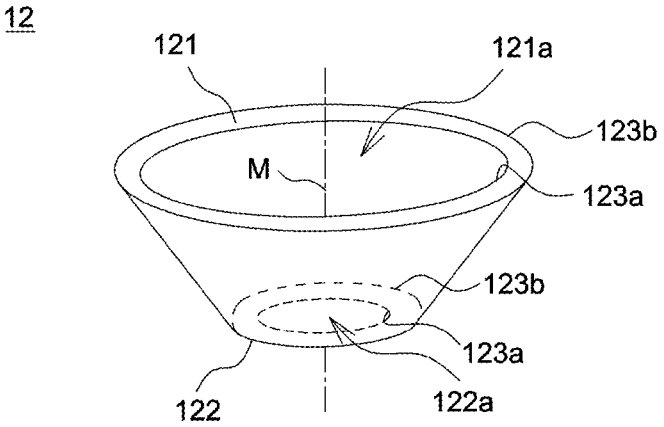
FIG. 3 shows a perspective view of a light guide in accordance with an embodiment of the invention.

FIG. 2 shows a schematic cross-section of an optical lens in accordance with an embodiment of the invention. FIG. 3 shows a perspective view of a light-guide in accordance with an embodiment of the invention. As shown in FIG. 2, the optical lens 10 includes a lens barrel (not shown), and a lens L1, a lens L2, a lens L3 and a lens L4 are arranged in order in a direction N of an optical axis of the optical lens 10. The optical lens 10 further includes a light guide 12 disposed adjacent to the lens L1. The lens barrel may be a cylindrical body shaped around the direction N to form an accommodation space for accommodating all lenses L1-L4 and the light guide 12. In this embodiment, the light guide 12 is an optical element capable of guiding light beams emitted from a light source (such as an LED) to target positions. In addition, light beams emitted from the light source may pass through the light guide 12 and all lenses L1-L4 but would not propagate in the lens barrel. In this embodiment, the light guide 12 may have any shape or design that may include, but is not limited to, a hollow cone, a cylinder, a light guide plate, a light pipe, and so forth. In this embodiment, the lens L1 has a positive refractive power, the lens L2 has a negative refractive power, and each lens may have a biconcave shape, biconvex shape, plano-concave shape, plano-convex shape or meniscus shape without limitation. As shown in FIG. 2, in this embodiment, the lens L1, the light guide 12 and the lens L2 are arranged in a direction N of an optical axis of the optical lens 10, the light guide 12 has an inner surface 12*a* and an outer surface 12*b* opposite the inner surface 12*a*, and the inner surface 12*a* touches at least a part of an outer edge LS of the lens L2.

As shown in FIG. 3, in this embodiment, opposing ends of the light guide 12 aligned in an axial direction M of the light guide 12 are a first end 121 and a second end 122, the first end 121 is provided with an opening 121*a*, and the second end 122 is provided with an opening 122*a*. In this embodiment, the second end 122 is closer to the lens L2 as compared with the first end 121, and an area of the opening 121*a* at the first end 121 is larger than an area of the opening 122*a* at the second end 122. In other embodiment, an area of the opening 121*a* at the first end 121 may be smaller than or equal to an area of the opening 122*a* at the second end 122. In this embodiment, the light guide 12 has the shape of a hollow cone, but the invention is not limited thereto. The light guide 12 in the form of a hollow body may have an inner perimeter 123*a* and an outer perimeter 123*b* opposite the inner perimeter 123*a*. Herein, an area enclosed by the inner perimeter 123*a* of the second end 122 is an oval area indicated by dashed lines of the inner perimeter 123*a* shown in FIG. 3. Further, in one embodiment, the lens L1, the first end 121 of the light guide 12, the lens L2, the second end 122 of the light guide 12 and the lens L3 are arranged in order in the axial direction M of the light guide 12.

Please refer to FIG. 2 again, in this embodiment, the lens L1, the first end 121 of the light guide 12, the lens L2, the second end 122 of the light guide 12 and the lens L3 are arranged in order in the direction N of the optical axis of the optical lens 10, and the second lens L2 may be entirely or partially disposed inside the opening 122*a* at the second end 122 of the light guide 12. In this embodiment, an area enclosed by the inner perimeter 123*a* of the second end 122 (an oval area indicated by dashed lines of the inner perimeter 123*a* shown in FIG. 3) is smaller than a radial area of the lens L3. As used in the specification and claims, the term "radial area" of a lens refers to a projection area of that lens projected along the direction N onto a plane orthogonal to the direction N. Further, in this embodiment, an area enclosed by the inner perimeter 123*a* of one end of the light guide 12 proximate to the lens L2 (i.e. the second end 122) is smaller than a radial area of the lens L2. In various embodiments of the invention, the light guide 12 may accommodate more than one lens or does not accommodate any lens without limitation.

As shown in FIG. 2, in one embodiment, a minimum distance between the first end 121 of the light guide 12 and the lens L1 is smaller than a minimum distance between the second end 122 of the light guide 12 and the lens L1. Besides, in one embodiment, the lens L1 has a first surface S1 and a second surface S2 opposite the first surface S1, a minimum distance between the first end 121 of the light guide 12 and the first surface S1 is larger than a minimum distance between the first end 121 of the light guide 12 and the second surface S2. Besides, in this embodiment, the optical lens 10 may further include an aperture stop 14, the aperture stop 14 is disposed adjacent to the second end 122 of the light guide 12, and the first surface S1 of the lens L1, the second surface S2 of the lens L1, the first end 121 of the light guide 12 and the aperture stop 14 may be arranged in order in the direction N of the optical axis of the optical lens 10. In one embodiment, a minimum distance between the second end 122 of the light guide 12 and the aperture stop 14 is smaller than 20 mm. In another embodiment, a minimum distance between the second end 122 of the light guide 12 and the aperture stop 14 is smaller than 10 mm. In still another embodiment, a minimum distance between the second end 122 of the light guide 12 and the aperture stop 14 is smaller than 5 mm. In one embodiment, the aperture stop 14 may be disposed entirely inside a region enclosed by the outer perimeter 123*b* of the second end 122 of the light guide 12.

Figure 4:
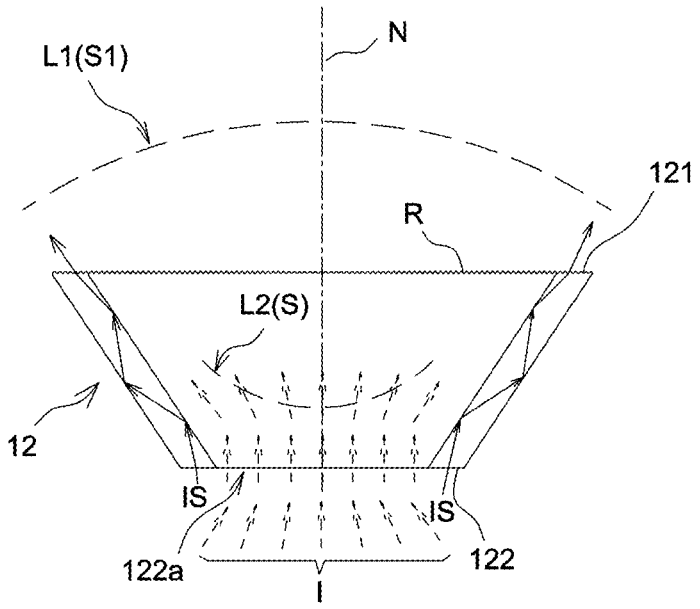
FIG. 4 shows a cross-section of a light guide in accordance with an embodiment of the invention.

FIG. 4 shows a cross-section of a light guide in accordance with an embodiment of the invention. As shown in FIG. 4, in one embodiment, an effective beam I for the optical lens 10 may be defined as a light beam capable of passing through a curved surface S with a refractive power of the lens L2 and entering the lens L1, and propagation paths of all effective beams I in the optical lens 10 form an active light transmission region of the optical lens 10. For example, FIG. 4 schematically shows a part of the active light transmission region of the optical lens 10 by dashed arrows. In this embodiment, an opening of the light guide 12 furthest away from the lens L1 (such as the opening 122*a* at the second end 122) is disposed at a narrowest part of the active light transmission region measured in the direction N. Further, in this embodiment, the light guide 12 is not disposed in the propagation paths of the effective beams I, i.e., disposed outside the active light transmission region. Under the circumstance, the light entering the light guide 12 is mainly the stray light IS but not the effective beams I, and thus the light guide 12 would not interfere with or affect propagation of the effective beams I used for imaging, but the invention is not limited thereto. In other embodiment, a part of the light guide 12 is disposed inside the active light transmission region, while the remaining part of the light guide 12 is disposed outside the active light transmission region to absorb stray light IS. Therefore, setting a positional relationship of the light guide 12 relative to the active light transmission region may open the possibility of adjusting respective amounts of stray light IS and effective beams I entering the light guide 12. Further, because the light guide 12 uses total internal reflection (TIR) to transport or direct stray light entering the light guide 12, the luminous uniformity of a light emission surface of the optical lens is enhanced, and, in that case, an aperture stop can be omitted from the optical lens 10. Besides, by properly setting inclined angles of sidewalls of the light guide 12, the stray light IS (possibly plus some effective beams I) entering the light guide 12 via the second end 122 is totally reflected inside the light guide 12, leaves the light guide 12 via the first end 121, and directed to a periphery of the first surface S1 (light emission surface of the optical lens). Therefore, dark zones on the periphery of the first surface S1 can be reduced to increase luminous uniformity of the light emission surface of the optical lens. Further, in one embodiment, the first end 121 of the light guide 12 is provided with a rough surface R (or micro structures) to enhance luminous efficiency.

Figure 1:
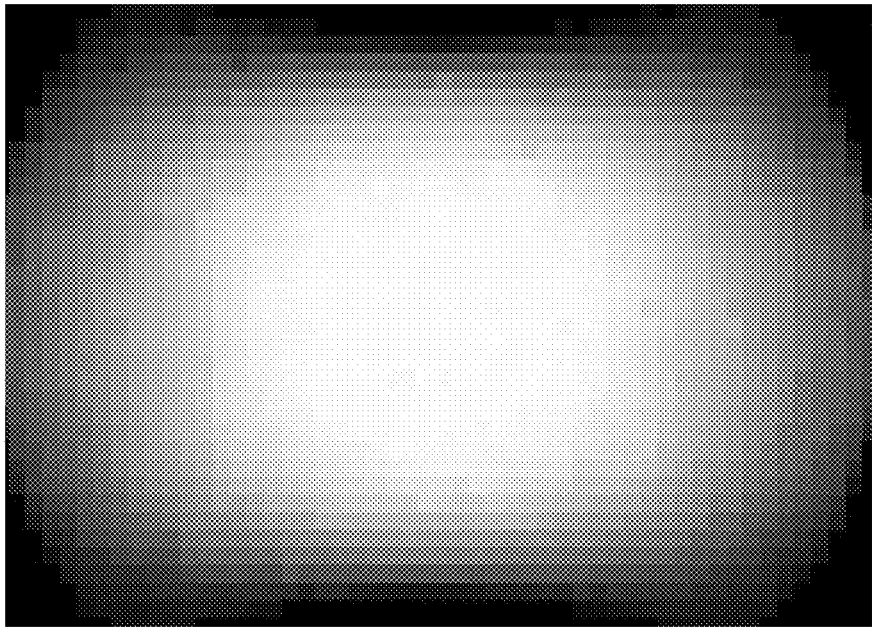
FIG. 1 (Prior Art)
FIG. 1 is a grayscale image of a light emission surface of a conventional optical lens.
Figure 5:
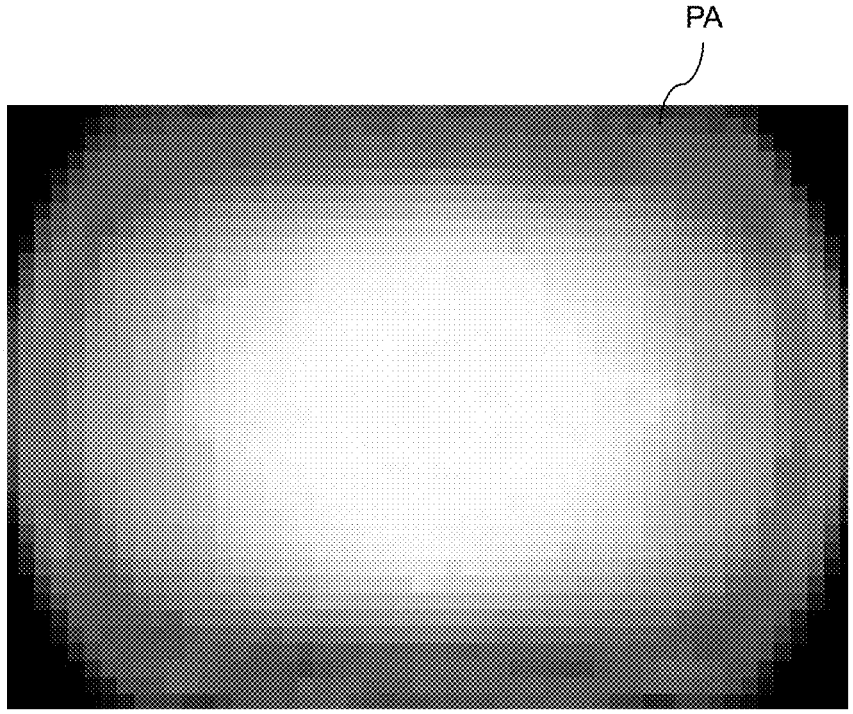
FIG. 5 is a grayscale image of a light emission surface of an optical lens shown in FIG. 2.
Figure 6:
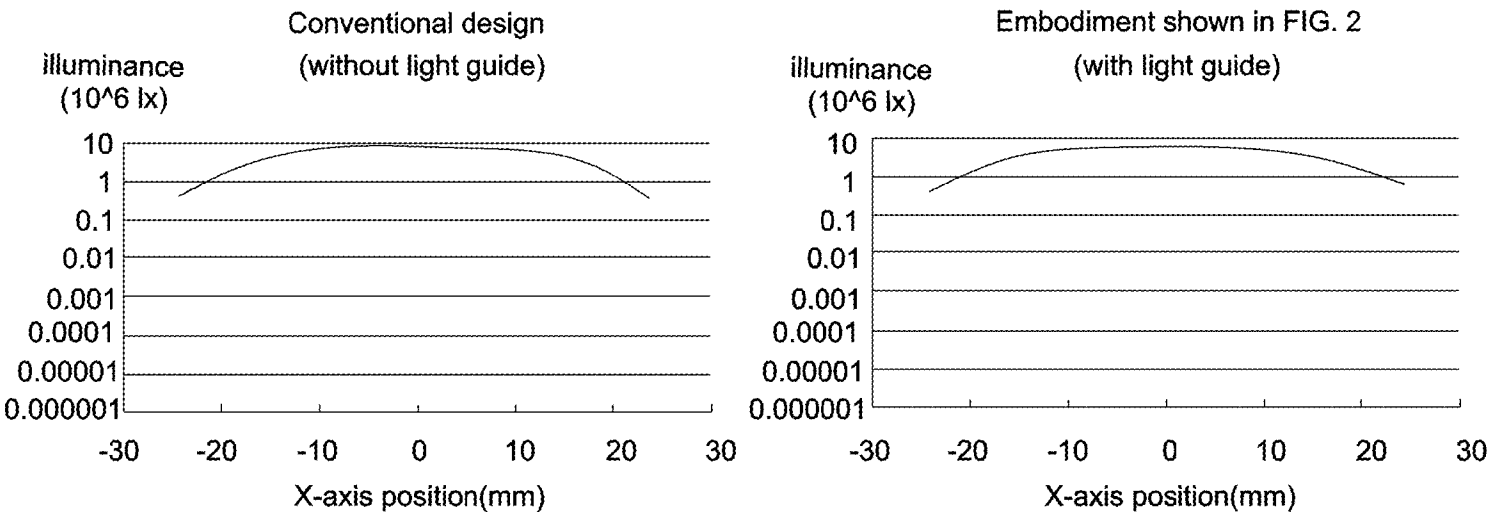
FIG. 6 shows graphs of illuminance versus X-axis position for a conventional design without a light guide compared with the embodiment shown in FIG. 2.
Figure 7:
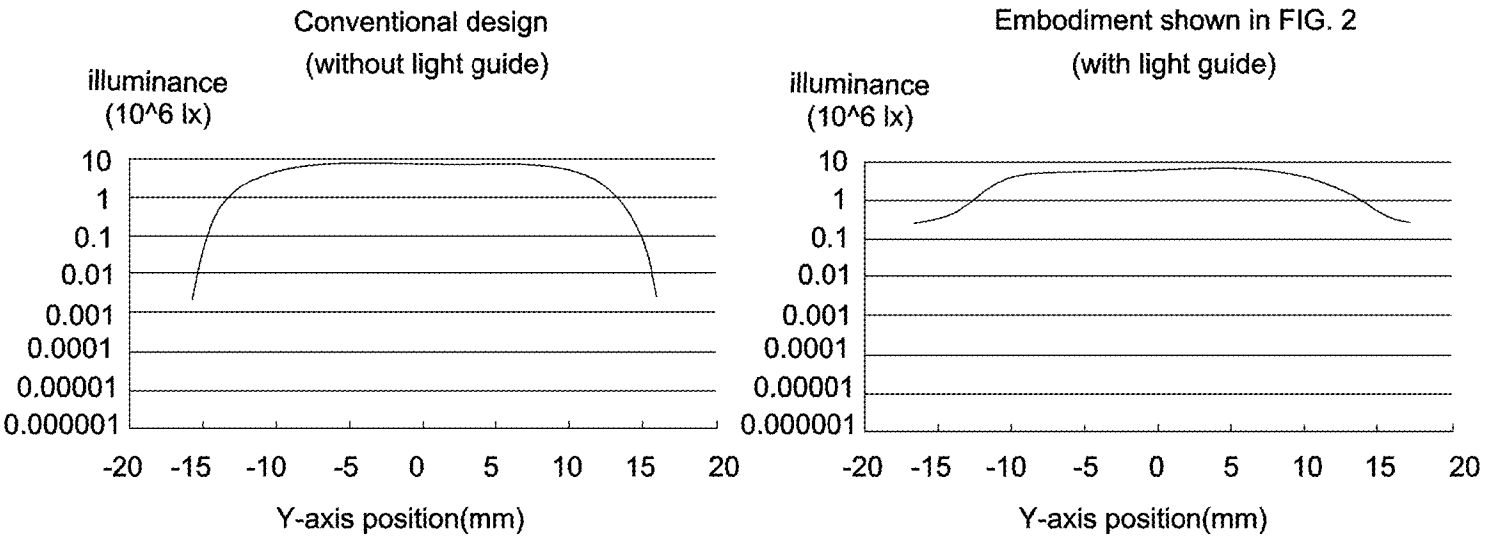
FIG. 7 shows graphs of illuminance versus Y-axis position for a conventional design without a light guide compared with the embodiment shown in FIG. 2.

FIG. 5 is a grayscale image of the surface S1 (light emission surface) of the lens L1 to illustrate brightness distribution of the embodiment shown in FIG. 2. Comparing FIG. 5 with FIG. 1, it can be seen the above embodiment may increase the amount of light irradiating the periphery of an optical lens to reduce peripheral dark zones PA and hence enhance the luminous uniformity and visual feels. FIG. 6 shows graphs of illuminance versus X-axis position for a conventional design without a light guide compared with the embodiment shown in FIG. 2. FIG. 7 shows graphs of illuminance versus Y-axis position for a conventional design without a light guide compared with the embodiment shown in FIG. 2. As can be seen in FIG. 6 and FIG. 7, the embodiment shown in FIG. 2 has considerably increased amount of light irradiating the periphery of an optical lens to enhance the luminous uniformity of the optical lens.

According the above embodiments, the optical lens is provided with a light guide 12 to increase the amount of light propagating in the periphery of the optical lens to enhance the luminous uniformity and hence the visual feels. Besides, because the light entering the light guide 12 is mainly the stray light IS that travels outside the active light transmission region, the stray light IS can be recycled for use to reduce loss of optical energy and thus improve light utilization efficiency.

Figure 8:
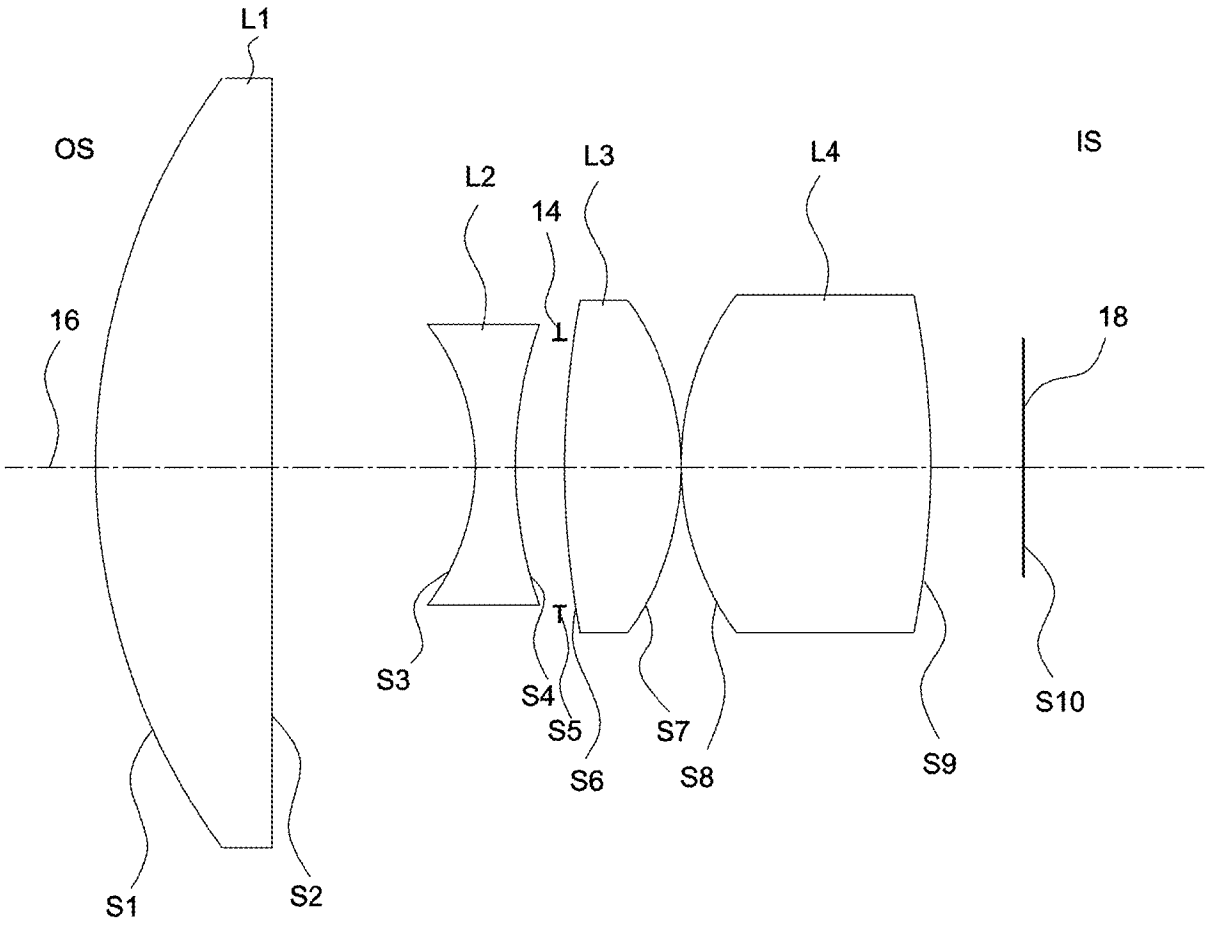
FIG. 8 shows a schematic layout of lenses in an optical lens in accordance with an embodiment of the invention.

FIG. 8 and Table 1 show the shape and design parameters of each lens in accordance with an embodiment of the invention. As shown in FIG. 8, a first lens L1, a second lens L2, an aperture stop 14, a third lens L3 and a fourth lens L4 are arranged in order along an optical axis 16 from a magnified side (such as a light-emitting side of a vehicle lamp) and a minified side (such as a light incident side proximate to a light source 18). The shape and design parameters of each lens are shown in the following Table 1.

TABLE 1

| surface | radius of curvature (mm) | interval (mm) | refractive index | Abbe number | object description |
|---|---|---|---|---|---|
| S1 | 40.65 | 11.31 | 1.80 | 46.57 | L1( plano-convex) |
| S2 | INF | 11.88 | | | |
| S3 | −17.28 | 4.11 | 1.70 | 30.05 | L2(biconcave) |
| S4 | 26.68 | 1.78 | | | |
| S5 | INF | 0.03 | | | aperture stop 14 |
| S6 | 90.39 | 7.17 | 1.80 | 46.57 | L3(biconvex) |
| S7 | −19.00 | 0.15 | | | |

TABLE 1-continued

| surface | radius of curvature (mm) | interval (mm) | refractive index | Abbe number | object description |
|---|---|---|---|---|---|
| S8 | 17.75 | 16.00 | 1.80 | 46.57 | L4( biconvex ) |
| S9 | −81.55 | 5.57 | | | |
| S10 | INF | 0.00 | | | light source 18 |

Figure 9:
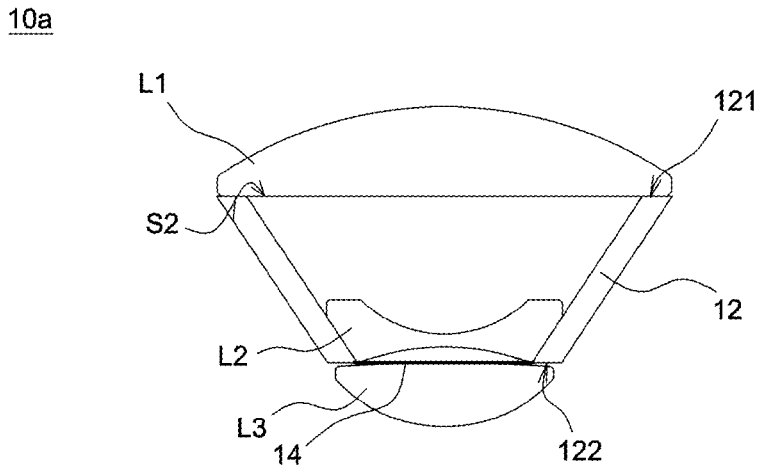
FIG. 9 shows a schematic cross-section of an optical lens in accordance with another embodiment of the invention.

In addition, in the above embodiments, the shape of a light guide and the number of lenses cooperating with the light guide are illustrative and not restrictive. In addition, the shape of a light guide and number of lenses may vary depending on the specific requirements of each device. For example, as shown in FIG. 9, an optical lens 10*a* may only include the lens L1, the lens L2 and the lens L3. In other embodiment, the lens L2 can be omitted from an optical lens, the lens L1 is disposed at the first end 121 of the light guide 12, the lens L3 is disposed at the second end 122 of the light guide 12, a surface of the first end 121 of the light guide 12 covers at least a part of a surface the lens L1, and a surface of the second end 122 of the light guide 12 covers at least a part of a surface of the lens L3.

Figure 10:
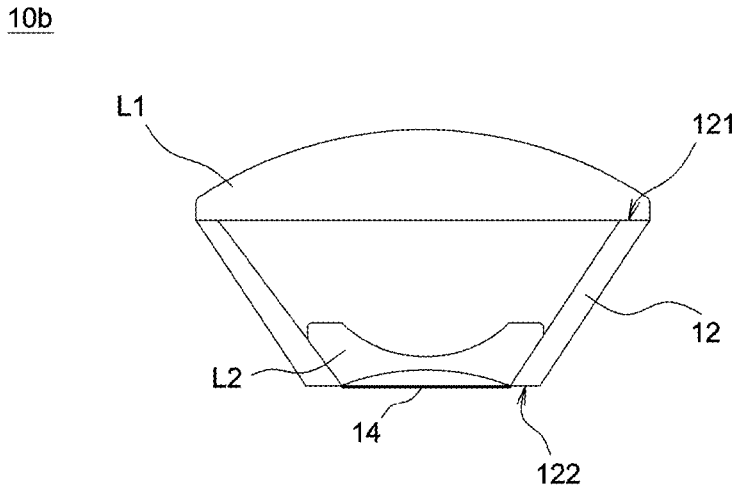
FIG. 10 shows a schematic cross-section of an optical lens in accordance with another embodiment of the invention.

As shown in FIG. 10, in other embodiment, the light guide 12 in an optical lens 10*b* may have an asymmetric shape (e.g., by sloping side walls at different angles) to meet specific light-emission requirements. Besides, the light guide 12 may cooperate with a lens assembly including only two lenses (such as the lens L1 and the lens L2). In one embodiment, in case the light guide 12 is so designed as to absorb most of the peripheral stray light, one end of the light guide 12 may function as an aperture stop to omit the aperture stop 14 from the optical lens. In one embodiment, the light guide may be made from plastic (such as PC or PMMA), and all lenses may be made from glass, but the invention is not limited thereto.

According to the above embodiments, an embodiment of fabricating an optical lens is described in the following. First, a lens barrel is provided, and a first lens, a second lens and a light guide having opposed openings are fixed inside the lens barrel. The first lens, the second lens, and the light guide are arranged in order in a direction of an optical axis of the optical lens. The light guide has a first end and a second end opposite the first end, and an inner surface of the light guide touching at least a part of an outer edge of the second lens.

Figure 11:
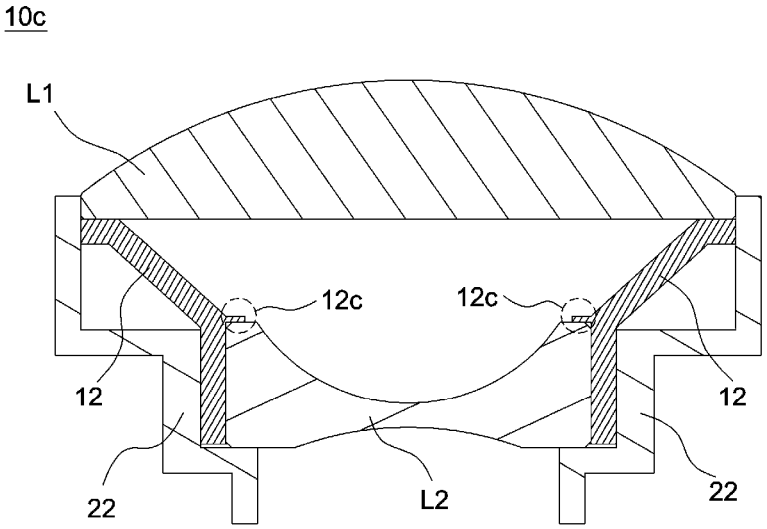
FIG. 11 shows a schematic cross-section of an optical lens in accordance with another embodiment of the invention.
Figure 12:
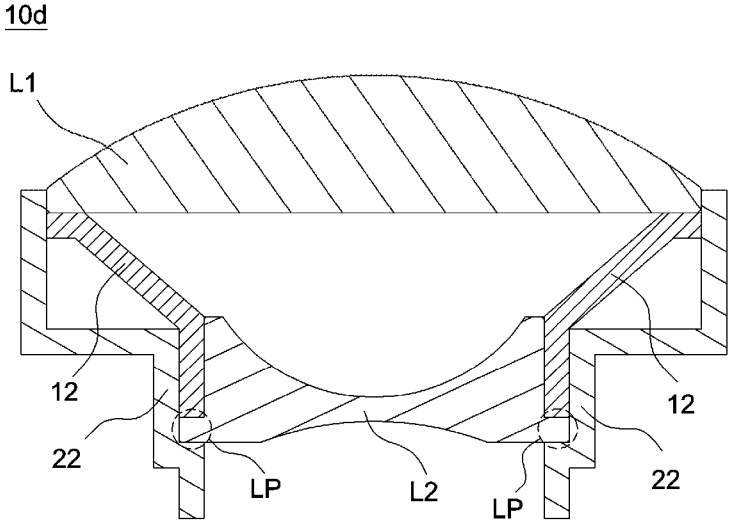
FIG. 12 shows a schematic cross-section of an optical lens in accordance with another embodiment of the invention.

The positioning relationship between a light guide and at least one lens is described in various embodiments below. As shown in FIG. 11, the light guide 12 of an optical lens 10*c* is provided with a flange 12*c*, so that one end of the light guide 12 may abut against the lens L1 and the flange 12*c* may press against the lens L2. Accordingly, the light guide 12 with a positioning structure is allowed to cooperate with a lens barrel 22 to fix at least one lens in the lens barrel 22, thereby eliminating the use of a separate positioning piece such as a spacer to hold a lens in place. In other embodiment, as shown in FIG. 12, the lens L2 is provided with a flange LP, so that one end of the light guide 12 may abut against the lens L1 and an opposed end of the light guide 12 may press against the flange LP of the lens L2 to fix the lens L2 in the lens barrel 22. In one embodiment, the flange 12*c* of the light guide 12 and the flange LP of the lens L2 may have an annular shape. In the above embodiment, the flange 12*c* is formed on an inner surface of the light guide 12, and the flange LP is formed on an outer edge of the lens L2, but the invention is not limited thereto. In various embodiments of the invention, the positioning or engagement structure for fixing the light guide and the lens relative to each other is not limited to a specific position, shape or construction. Besides, the above embodiments that use the positioning structure to fix the lens L2 is merely an example, and the positioning structure may be used to fix any other lens without limitation.

Figure 13:
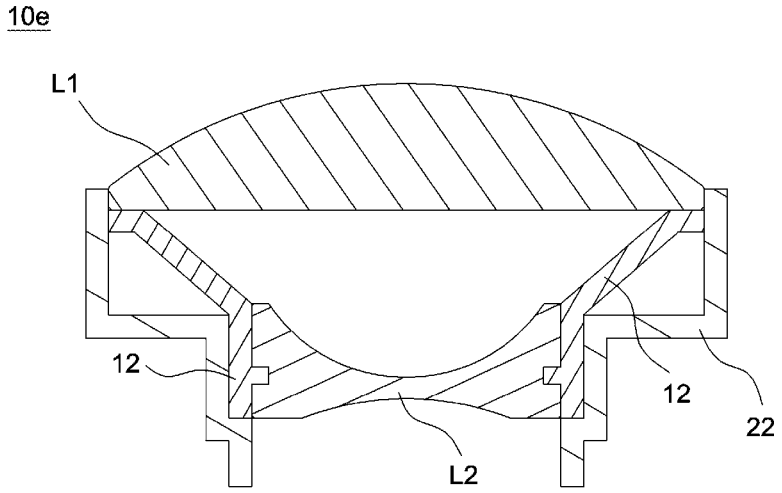
FIG. 13 shows a schematic cross-section of an optical lens in accordance with another embodiment of the invention.
Figure 14:
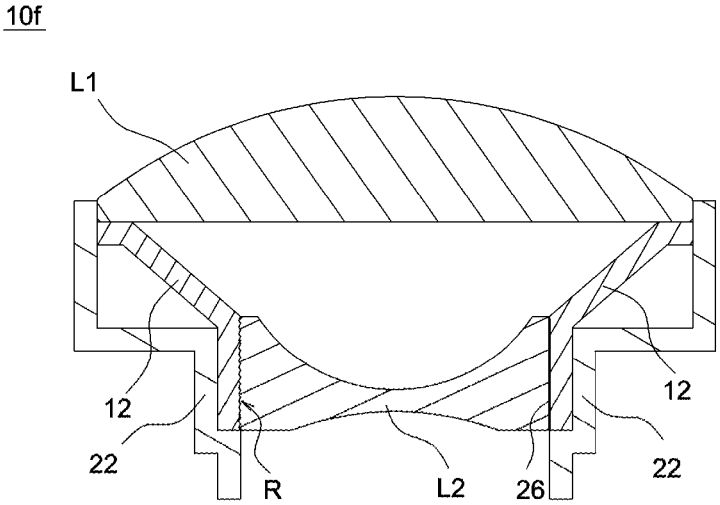
FIG. 14 shows a schematic cross-section of an optical lens in accordance with another embodiment of the invention.

In other embodiment, the light guide 12 and at least one lens may be integrally formed as one piece by in-mold injection. For example, as shown in FIG. 13, the light guide 12 of an optical lens 10*e* and at least one lens (such as the lens L2) are integrally formed as one piece by in-mold injection, and one end of the light guide 12 abuts against the lens L2 to fix all lenses in the lens barrel 22. In other embodiment, as shown in FIG. 14, a rough surface R may be provided on an outer edge of the lens L2 of an optical lens 10*f* or an inner surface of the light guide 12 to hold the lens L2 in place relative to the light guide 12, without sliding in the direction of an optical axis of the optical lens 10*f*. Alternatively, an adhesive layer 26 such as a dispensing layer may be disposed between the lens L2 and the light guide 12 to allow the lens L2 to be adhered to the light guide 12 and lean against the lens barrel 22, thereby holding the lens L2 in place in the lens barrel 22.

Though the embodiments of the invention have been presented for purposes of illustration and description, they are not intended to be exhaustive or to limit the invention. Accordingly, many modifications and variations without departing from the spirit of the invention or essential characteristics thereof will be apparent to practitioners skilled in this art. It is intended that the scope of the invention be defined by the claims appended hereto and their equivalents in which all terms are meant in their broadest reasonable sense unless otherwise indicated.

What is claimed is:

1. An optical lens, comprising:

a first lens, a light guide and a second lens being arranged in order in a direction of an optical axis of the optical lens, the light guide having a first end and a second end opposite the first end, and an inner surface of the light guide touching at least a part of an outer edge of the second lens.

2. The optical lens as claimed in claim 1, wherein the first lens has a positive refractive power, and the second lens has a negative refractive power.

3. The optical lens as claimed in claim 1, wherein the second end is closer to the second lens as compared with the first end of the light guide, each of the first end and the second end is provided with an opening, and an area enclosed by an inner perimeter of the second end is smaller than a radial area of the second lens.

4. The optical lens as claimed in claim 1, wherein the optical lens further comprises a third lens, the second end is closer to the second lens as compared with the first end of the light guide, each of the first end and the second end is provided with an opening, and an area enclosed by an inner perimeter of the second end is smaller than a radial area of the third lens.

5. The optical lens as claimed in claim 1, wherein an aperture stop is disposed adjacent to the second end of the light guide, and a minimum distance between the second end and the aperture stop is smaller than 20 mm.

6. The optical lens as claimed in claim 5, wherein the aperture stop is disposed entirely inside a region enclosed by an outer perimeter of the second end of the light guide.

7. The optical lens as claimed in claim 1, wherein the light guide is disposed outside an active light transmission region of the optical lens.

8. The optical lens as claimed in claim 1, wherein the light guide has a shape of a hollow cone.

9. The optical lens as claimed in claim 1, wherein at least a part of the second lens is disposed inside the light guide.

10. An optical lens, comprising:

a first lens, a light guide and a second lens arranged in order in a direction of an optical axis of the optical lens, the light guide having a first end and a second end opposite the first end, each of the first end and the second end being provided with an opening, an area of the opening at the first end being larger than an area of the opening at the second end, at least a part of the second lens being disposed inside the opening at the second end, and a positioning structure is provided on corresponding positions of an inner surface of the light guide and an outer edge of the second lens to fix the light guide and the second lens relative to each other.

11. The optical lens as claimed in claim 10, wherein the positioning structure is a flange formed on the light guide or the second lens.

12. The optical lens as claimed in claim 10, wherein the positioning structure is a rough surface disposed between the light guide and the second lens.

13. The optical lens as claimed in claim 10, wherein the positioning structure is an adhesive layer disposed between the light guide and the second lens.

14. The optical lens as claimed in claim 10, wherein the second lens and the light guide are integrally formed as one piece by in-mold injection.

15. The optical lens as claimed in claim 10, wherein the second end is closer to the second lens as compared with the first end of the light guide, and an area enclosed by an inner perimeter of the second end is smaller than a radial area of the second lens.

16. The optical lens as claimed in claim 10, wherein the optical lens further comprises a third lens, the second end is closer to the second lens as compared with the first end of the light guide, and an area enclosed by an inner perimeter of the second end is smaller than a radial area of the third lens.

17. The optical lens as claimed in claim 10, wherein the light guide is disposed outside an active light transmission region of the optical lens.

18. An optical lens, comprising:

a light guide having a first end and a second end opposite the first end;

a first lens disposed at the first end of the light guide, and a surface of the first end covering at least a part of a surface of the first lens; and a second lens disposed at the second end of the light guide, and a surface of the second end covering at least a part of a surface of the second lens.

19. The optical lens as claimed in claim 18, wherein an aperture stop is disposed adjacent to the second end of the light guide, a minimum distance between the second end and the aperture stop is smaller than 20 mm.

20. The optical lens as claimed in claim 18, wherein the light guide is disposed outside an active light transmission region of the optical lens.

* * * * *